US006055491A

United States Patent [19]

Biliris et al.

[11] Patent Number: 6,055,491

[45] Date of Patent: Apr. 25, 2000

[54] METHOD AND APPARATUS FOR ANALYZING CO-EVOLVING TIME SEQUENCES

[75] Inventors: Alexandros Biliris, Chatham, N.J.; Christos N. Faloutsos, Silver Spring, Md.; Hosagrahar Visvesvaraya Jagadish, Berkeley Heights, N.J.; Theodore Johnson, New York, N.Y.; Nikolaos Dimitrios Sidriopoulos, Charlottesville, Va.; Byoung-Kee Yi, Greenbelt, Md.

[73] Assignees: AT&T Corp., New York, N.Y.; University of Maryland, College Park, Md.

[21] Appl. No.: 08/953,578

[22] Filed: Oct. 17, 1997

[51] Int. Cl.[7] ..... G06G 7/19

[52] U.S. Cl. ..... 702/176; 702/179; 702/181

[58] Field of Search ..... 702/176, 179, 702/181; 705/10

[56] References Cited

U.S. PATENT DOCUMENTS

| | | | |
|---|---|---|---|
| 5,493,516 | 2/1996 | Broomhead et al. | 364/553 |
| 5,586,066 | 12/1996 | White et al. | 364/576 |
| 5,745,383 | 4/1998 | Barber | 364/554 |

OTHER PUBLICATIONS

Kil et al., "Optimum Wiindow Size for Time Series Prediction", IEEE, Mar. 1997.

*Primary Examiner*—Patrick Assouad

[57] ABSTRACT

An analyzer system that analyzes a plurality of co-evolving time sequences to, for example, perform correlation or outlier detection on the time sequences. The plurality of co-evolving time sequences comprise a delayed time sequence and one or more known time sequences. A goal is to predict the delayed value given the available information. The plurality of time sequences have a present value and (N−1) past values, where N is the number of samples (time-ticks) of each time sequence. The analyzer system receives the plurality of co-evolving time sequences and determines a window size ("w"). The analyzer then assigns the delayed time sequence as a dependent variable and the present value of a subset of the known time sequences, and the past values of the subset of known time sequences and the delayed time sequence, as a plurality of independent variables. Past values delayed by up to "w" steps are considered. The analyzer then forms an equation comprising the dependent variable and the independent variables, and then solves the equation using a least squares method. The delayed time sequence is then determined using the solved equation.

23 Claims, 7 Drawing Sheets

FIG. 3

```
algorithm Selection
   S := {};                    /*Set of selected variables*/
   R := {x_I, ..., x_V};       /*Set of remaining variables*/
   while (S contains less than b variables)
      for each x in R
         Compute EPE for S ∪ {x};
      pick x with minimum EPE;
      remove x from R and add to S;
   end while
   report variables in S;
end algorithm
```

METHOD AND APPARATUS FOR ANALYZING CO-EVOLVING TIME SEQUENCES

FIELD OF THE INVENTION

The present invention is directed to analyzing co-evolving time sequences. More particularly, the present invention is directed to a method and apparatus for analyzing co-evolving time sequences using least squares regression.

BACKGROUND OF THE INVENTION

In many applications, data of interest comprises multiple sequences that each evolve over time. Examples include currency exchange rates, network traffic data from different network elements, demographic data from multiple jurisdictions, patient data varying over time, and so on.

These sequences are not independent—in fact they frequently exhibit a high correlation. Therefore, much useful information is lost if each sequence is analyzed individually. It is therefore desirable to be able to analyze the entire set of sequences as a whole, where the number of sequences in the set can be very large. For example, if each sequence represents data recorded from a network element in some large network, then the number of sequences could easily be in the several thousands, and even millions.

It is typically the case that the results of an analysis are most useful immediately, based upon the portion of each sequence seen so far, without waiting for "completion". In fact, these sequences can be extremely long, and may have no predictable termination in the future. What is required is to be able to "repeat" the analysis as the next element (or batch of elements) in each data sequence is revealed. This must be done on potentially very long sequences, indicating a need for analytical techniques that have low incremental computational complexity.

TABLE 1

| | sequence | | | |
|---|---|---|---|---|
| time | $s_1$ packets-sent | $s_2$ packets-lost | $s_3$ packets-corrupted | $s_4$ packets-repeated |
| 1 | 50 | 20 | 10 | 3 |
| 2 | 55 | 20 | 10 | 10 |
| . | . | . | . | . |
| . | . | . | . | . |
| . | . | . | . | . |
| N − 1 | 73 | 25 | 18 | 12 |
| N | ?? | 25 | 18 | 18 |

Table 1 above illustrates a snapshot of a set of co-evolving sequences. k=4 time sequences are illustrated, and the value of each time sequence at every time-tick (e.g., every minute) is desired. Suppose that one of the time sequences, e.g., $s_1$, is always delayed by a little, designated by "??". The desired analysis is to do the best prediction for the last "current" value of this sequence, given all the past information about this sequence, and all the past and current information for the other sequences. It is desired to do this at every point of time, given all the information up to that time.

More generally, given a missing or delayed value in some sequence, it is desirable to be able to estimate it as best as possible using all other information available from this and other related sequences. Using the same analysis, "unexpected values" when the actual observation differs greatly from its estimate computed as above can also be found. Such an "outlier" may be indicative of an interesting event in the specific time series affected.

A closely associated problem to solve is the derivation of (quantitative) correlations, e.g., "the number of packets-lost" is perfectly correlated with "the number of packets corrupted", or "the number of packets-repeated" lags "the number of packets-corrupted" by 1 time-tick.

Methodologies are known that analyze single time sequences. One example is the "Box-Jenkins" methodology, also referred to as the "Auto-Regression Integrated Moving Average", disclosed in, for example, George Box et al., "Time Series Analysis: Forecasting and Control", Prentice Hall, Englewood Cliffs, N.J., 1994, 3rd Edition. However, the Box-Jenkins methodology focuses on a single time sequence rather than multiple co-evolving time sequences.

Based on the foregoing, there is a need for a method and apparatus that can analyze co-evolving sequences to solve the above-described problems. The analysis should be able to adapt to changing correlations, be on-line and scalable, be able to make predictions in time that are independent of the number N of past time-ticks, and scale up well with the number of time sequences k.

SUMMARY OF THE INVENTION

One embodiment of the present invention is an analyzer system that analyzes a plurality of co-evolving time sequences to, for example, perform correlation or outlier detection on the time sequences. The plurality of co-evolving time sequences comprise a delayed time sequence and one or more known time sequences. A goal is to predict the delayed value given the available information. The plurality of time sequences have a present value and (N−1) past values, where N is the number of samples (time-ticks) of each time sequence.

The analyzer system receives the plurality of co-evolving time sequences and determines a window size ("w"). The analyzer then assigns the delayed time sequence as a dependent variable and the present value of a subset of the known time sequences, and the past values of the subset of known time sequences and the delayed time sequence, as a plurality of independent variables. Past values delayed by up to "w" steps are considered. The analyzer then forms an equation comprising the dependent variable and the independent variables, and then solves the equation using a least squares method. The delayed time sequence is then determined using the solved equation.

In another embodiment of the present invention, the known time sequences are first preprocessed so that only a small subset of the known time sequences is selected to predict the delayed time sequence. The preprocessing minimizes the expected prediction error for the dependent variable.

BRIEF DESCRIPTION OF THE DRAWINGS

FIG. 3 is pseudo-code that implements the "greedy" algorithm to select the best "b" known time sequences.

DETAILED DESCRIPTION

A. Basic Concepts

In order to describe the present invention, it is helpful to review some fundamental concepts regarding "least squares regression."

1. (Univariate) Linear Regression

"Least Squares" or "linear" regression is a traditional tool in data analysis. In its simplest form, there exists an "independent" variable x (e.g., the age of an employee) and a "dependent" variable y (e.g., the salary of that employee) that must be predicted. Given N samples(x[i],y[i]), there must be found a linear fit, i.e., the slope a and intercept b such that the estimates $\hat{y}$ $$\hat{y}=ax+b \tag{1}$$

are the best in the sense of least squares:

$$\min_{a,b}\sum_{i=1}^{N}(y[i]-\hat{y}[i])^2 \tag{2}$$

Figure 1:
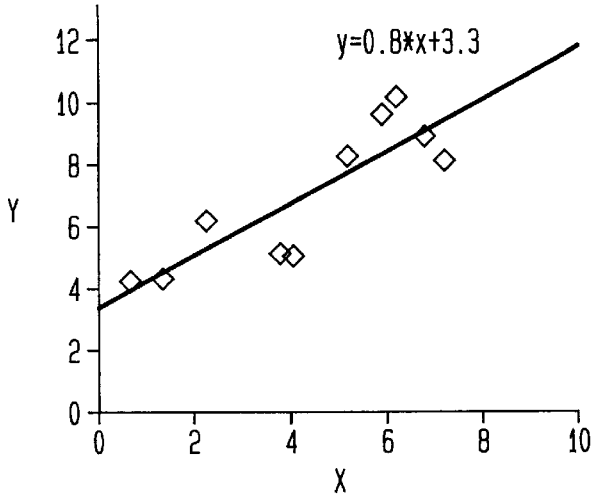
FIG. 1 graphically illustrates a set of points and a corresponding regression line.

The formula for the slope a and the intercept b is well known and is disclosed in, for example, William H. Press et. al., "Numerical Recipes in C", Cambridge University Press, 1992, 2nd Edition. FIG. 1 illustrates a set of (x, y) points and the corresponding regression line, with slope a=0.8 and intercept b=3.3.

Table 2 below gives a list of symbols used in the rest of this detailed description:

TABLE 2

| | |
|---|---|
| $\lambda$ | forgetting factor (1, when the past is not forgotten) |
| v | number of independent variables in multi-variate regression |
| k | number of co-evolving sequences |
| b | count of "best independent variables" |
| y | the dependent variable that is predicted |
| $\hat{y}$ | estimate of the dependent variable y |
| $\hat{\mathbf{y}}$ | the column vector with all samples of the dependent variable y |
| y[j] | the j-th sample of the dependent variable y |
| $x_i$ | the i-th independent variable |
| $x_i[j]$ | the j-th sample of the variable $x_i$ |
| $\mathbf{x}_i$ | the column vector with all the samples of the variable $x_i$ |
| x[j] | the row vector with j-th samples of all variables $x_i$ |
| w | span of regression window |

2. Multi-Variate Regression

The approach has been extended to handle multiple, i.e., v independent variables. The technique is called "multi-variate regression." Thus, given N samples, $$(x_1[i],x_2[i],\ldots,x_v[i],y[i])\ 1,\ldots,N$$

the goal is to find the values $a_1,\ldots,a_v$ that give the best predictions for y $$\hat{y}=a_1x_1+\ldots+a_vx_v \tag{3}$$

in the sense of least square error. That is, the $a_1,\ldots,a_v$ is determined that minimizes $$\min_{a_1,\ldots,a_v}\sum_{i=1}^{N}(y[i]-\hat{y}[i])^2 \tag{4}$$

The values $a_1,\ldots,a_v$ are called "regression coefficients". Using matrix notation, the solution is given compactly by:

$$a=(X^T\times X)^{-1}\times(X^T\times y) \tag{5}$$

where the superscripts T and −1 denote the transpose and the inverse of a matrix, respectively; x denotes matrix multiplication; y is the column vector with the samples of the dependent variable; a is the column vector with the regression coefficients; and the matrix X is the N×v matrix with the N samples of the v independent variables. That is:

$$x=\begin{bmatrix} x_1[1] & x_2[1] & \ldots & x_v[1] \\ x_1[2] & x_2[2] & \ldots & x_v[2] \\ \vdots & \vdots & \ldots & \vdots \\ x_1[N] & x_2[N] & \ldots & x_v[N] \end{bmatrix} \tag{6}$$

Recall that $x_j[i]$ denotes the i-th sample of the j-th independent variable.

The major bottleneck in the multi-variate regression is the inversion of the $X^T\times X$. This can be called D, for shorthand, where D stands for "data". Note that its dimensions are v×v, and its inversion would normally take $O(v^3)$ time. However, due to its special form and in accordance with the so-called "matrix inversion lemma" disclosed in S. Haykin, "Adaptive Filter Theory", Prentice Hall, Englewood Cliffs, N.J., 1996, $D^{-1}$ can be computed with the method of Recursive Least Squares ("RLS"), at computation cost of only $O(v^2)$ The idea is to consider only the first n samples of the matrix X, and to express the required inverse matrix $(D_n)^{-1}$ recursively, as a function of the $(D_{n-1})^{-1}$, where $D_n$ and $D_{n-1}$ denote D with the first n and n−1 samples, respectively. The updating of the matrix takes only $O(v^2)$ every time a new sample arrives. This setting is exactly what is needed for the previously described problem with time sequences, where indeed samples arrive one at a time.

In addition to its lower complexity, RLS also allows for graceful "forgetting" of the older samples. This method is called "Exponentially Forgetting RLS." Thus, let $\lambda<1$ be the forgetting factor, which means that an attempt is made to find the optimal regression coefficient vector a to minimize $$\min_{a}\sum_{i=1}^{N}\lambda^{(N-i)}(y[i]-\hat{y}[i])^2 \tag{7}$$

For $\lambda\leqq 1$, errors for old values are downplayed by a geometric factor, and hence it permits the estimate to adapt as sequence characteristics change.

Compared to the straightforward matrix inversion of Equation 5, the RLS method has the following advantages:

1) RLS needs O(v) to make a prediction, and $O(v^2)$ per sample to update the appropriate matrix versus $O(v^3)$ per sample for the straightforward LS.
2) RLS allows the use of a "forgetting factor" $\lambda\leqq 1$, which downplays geometrically the importance of past observations.

B. The Present Invention

1. Solving the Delayed Sequence Problem

One embodiment of the present invention solves the "delayed sequence" problem shown in Table 1. The delayed sequence problem can be stated as follows:

Consider k time sequences $s_1, \ldots, s_k$ being updated at every time-tick. Let one of them, say, the first one $s_1$ (the "delayed time sequence"), be consistently late (e.g., due to a time-zone difference, or due to a slower communication link). Make the best guess for $\hat{s}_1$ for time t, given all the information available.

The first step in the present invention is to use two sources of information:

1) the past values of the given or delayed time sequence $s_1$, i.e., $s_1[t-1]$, $s_1[t-2]$, . . .; and 2) the past and present values of the other time sequences $s_2, s_3, \ldots$ Based on that, the next step is to build a linear regression model, which can be solved with Recursive Least Squares, as previously discussed, or any other least squares method.

The present invention utilizes a linear regression model, and, for the given stream $s_1$, estimates its value as a linear combination of the values of the same and the other time sequences within a window of w, which is referred to as the "regression window".

The regression model is as follows:

$$\hat{s}_1[t] = a_{1,1}s_1[t-1] + \ldots + a_{1,w}s_1[t-w] + a_{2,0}s_2[t] + a_{2,1}s_2[t-1] + \ldots + a_{2,w}s_2[t-w] + \ldots\ a_{v,0}s_v[t] + a_{k,1}s_k[t-1] + \ldots + a_{k,w}s_k[t-w], \quad (8)$$

for all t=w+1 . . . ,N.

A delay operator $D^d(.)$ is defined as follows:

For a time sequence s=(s[1], . . . ,s[N]), the delay operator $D^d(.)$ delays it by d steps, i.e., $$D^d(s)=(\ldots,s[N-d-1],s[N-d]) \quad (9)$$

Equation (8) is a linear regression problem, with $s_1$ being the dependent variable ("y") , and $D^1(s_1), \ldots, D^w(s_1), s_2, D^1(s_2), \ldots, D^w(s_2), \ldots, s_k, D^1(s_k), \ldots, D^w(s_k)$ the "independent" variables. Thus, the present invention can use Equation (5) to solve for the regression coefficients. Notice that the number of independent variables is v=k*w+k−1.

The choice of the window "w" has attracted a lot of interest in forecasting and signal processing, and is beyond the scope of this application. Typical approaches include the Akaike Information Criterion (AIC) and Minimum Description Language (MDL) which are disclosed in, for example, George Box et al., "Time Series Analysis: Forecasting and Control", Prentice Hall, Englewood Cliffs, N.J., 1994, 3rd Edition.

Figure 2:
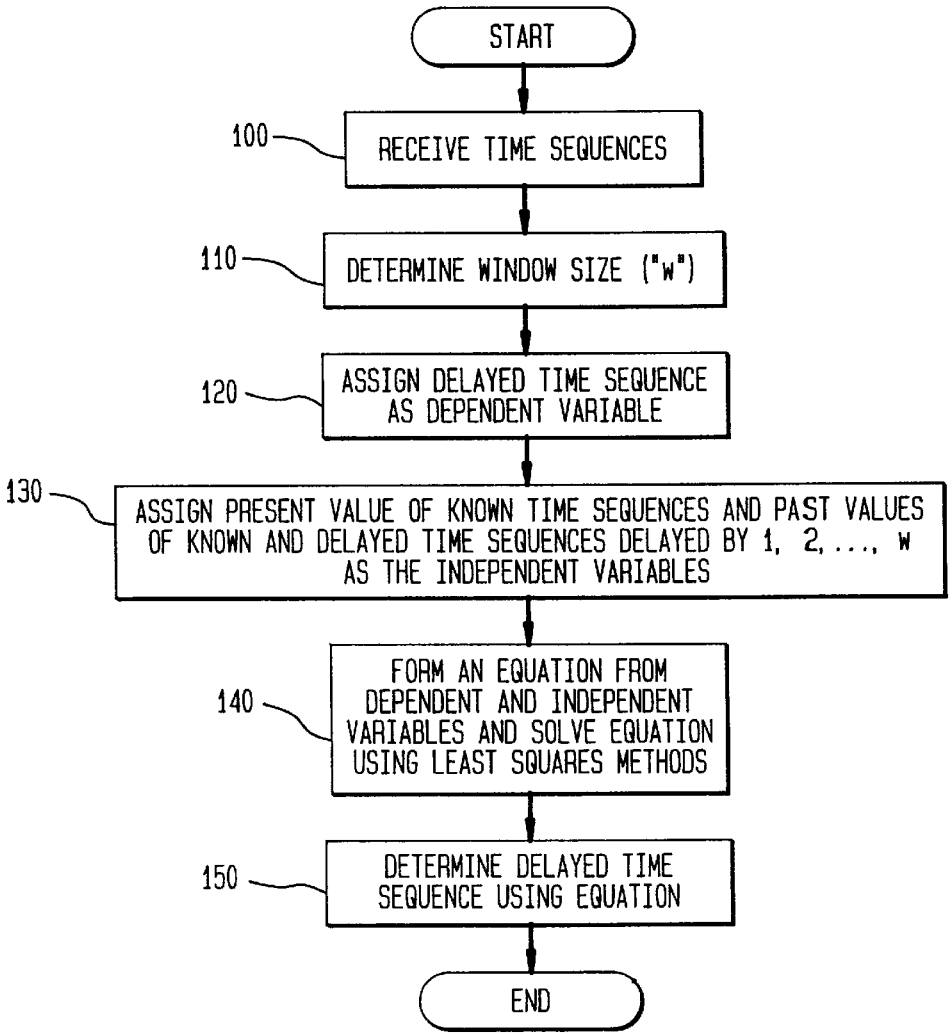
FIG. 2 is a flowchart illustrating the steps performed by the present invention to analyze time sequences.

FIG. 2 is a flowchart illustrating the steps performed by the present invention to analyze time sequences. In one embodiment, the steps are implemented in software and executed on a general purpose computer.

At step 100, the time sequences are received. The time sequences include a time sequence with an unknown variable, referred to as the "delayed time sequence" (i.e., $s_1$) and time sequences with known variables, referred to as the "known time sequences" (i.e., $s_2$, $s_3$, etc.). Further, the time sequences have a present value and (N−1) past values, where N is the number of samples of each time sequence.

At step 110 the window size "w" is determined.

At step 120, the delayed time sequence ($s_1$) is assigned as a dependent variable.

At step 130, the present value of all known time sequences ($s_2, s_3, \ldots, s_k$) are assigned as independent variables. Also assigned as independent variables are the past values (delayed by 1, 2, . . . , w steps) of all the known time sequences, as well as the delayed time sequences.

At step 140 an equation is formed that includes the dependent variables and independent variables. The equation is then solved using least squares methods. In one embodiment, RLS is the least squares method used at step 140. In another embodiment, Exponentially Forgetting RLS is the least squares method used at step 140.

Finally, at step 150 the unknown variables in the delayed time sequence are determined using the solved equation from step 140.

2. Preprocessing the Time Sequences

In case there are too many time sequences (e.g., k=100,000 nodes in a network, producing information about their load every minute), a reduction in the number of time sequences is needed to efficiently analyze the time sequences using the previously described embodiment of the present invention. Therefore, another embodiment of the present invention preprocesses a training set to find promising (i.e., highly correlated) time sequences, and performs the regression using only these time sequences. Therefore, in this embodiment, the steps shown in FIG. 2 are executed after the time sequences are preprocessed so that they include a subset of the original set of time sequences.

Following the running assumption, sequence $s_1$ is the time sequence notoriously delayed and which needs to be predicted. For a given regression window span w, among the v independent variables, the present invention must choose the ones that are most useful in predicting the delayed value of $s_1$.

In its abstract form, the problem is as follows:

Given v independent variables $x_1, x_2, \ldots, x_v$ and a dependent variable y with N samples each and the number b<v of independent variables that are to be considered, find the best such b independent variables to minimize the least-square error for $\hat{y}$ for the given samples.

A measure of goodness is needed to decide which subset of b variables is the best that can be chosen. Ideally, it is expected that the best subset yields the smallest prediction error in the future. Since, however, future samples are not available, the "expected prediction error" ("EPE") from the available samples can only be inferred as follows:

$$EPE(S) = \sum_{i=1}^{N} (y[i] - \hat{y}_s[i])^2$$

where S is the selected subset of variables and $\hat{y}_s[i]$ is the prediction based on S for the i-the sample.

If only b=1 independent variable is allowed to be kept, the optimal one is the one that has the highest (in absolute value) correlation coefficient with y.

In order to choose the second best independent variable, the present invention uses a "greedy" algorithm which is shown as pseudo-code in FIG. 3. At each step s, the independent variable $x_s$ is selected that minimizes the EPE for the dependent variable y, in light of the s−1 independent variables that have already been chosen in the previous steps.

The algorithm requires $O(N \times v \times b^2 + v \times b^3)$ time; b is usually small (≦10) and fixed. The subset-selection can be done infrequently and off-line, e.g., every N=W time-ticks, where W is a large number corresponding to, for example, a month's duration.

Choosing a small subset of independent variables often has a double benefit: not only does it drastically decrease the time to predict the delayed values of so, but, as shown below, it often improves the prediction error.

The present invention allows for the following types of analysis of time sequences:

Correlation detection: Provided every sequence has been normalized to have zero mean and unit variance, a high absolute value for a regression coefficient means that the corresponding variable is valuable for the prediction of $s_1$.

On-line outlier detection: Informally, an outlier is a value that is much different than what is expected. If it is assumed that the prediction error follows a Gaussian distribution with standard deviation a, then every sample of $s_1$ that is $\geqq 2\sigma$ away from its predicted value can be labeled as an "outlier". The reason is that, in a Gaussian distribution, 95% of the probability mass is within $\pm 2\sigma$ from the mean. Thus, the situations where the expected/predicted value is much different than the actual one can be easily spotted and reported as an anomaly or an interesting event to a monitor device that can take appropriate action. For instance, in a network management context, such an observation may indicate a failing component, or an unexpected change in network traffic patterns.

Back-casting and missing values: If a value is missing, corrupted or suspect in the time sequences, it can be treated as "delayed" and forecasted. In addition, past (e.g., deleted) values of the time sequences can be estimated by doing back-casting. In this case, the past value is expressed as a function of the future values, and a multi-sequence regression model is set up.

Adapting to changing correlations: This can be handled easily by setting the forgetting factor $\lambda$ to a value smaller than one.

C. Experiments Using the Present Invention

Several experiments were performed using the present invention and the following real datasets:

CURRENCY: Exchange rates of k=6 currencies (Hong-Kong Dollar (HKD), Japanese Yen (JPY), US Dollar (USD), German Mark (DEM), French Franc (FRF), and British Pound (GBP)). There are N=2561 daily observations for each currency. The base currency was the Canadian Dollar (CAD).

MODEM: Modem traffic data from a pool of k=14 modems, N=1500 time-ticks, reporting the total packet traffic for each modem, per 5-minute intervals.

INTERNET: Internet usage data for several sites. Included are four data streams per site, measuring different aspects of the usage (e.g., connect time, traffic and error in packets etc.) For each of the data streams, N=980 observations were made.

The following synthetic dataset was also used to illustrate the adaptability of the present invention:

SWITCH: ("switching sinusoid") 3 sinusoids $s_1$, $s_2$, $s_3$ with N=1,000 time-ticks each;

$$s_1[t] = s_2[t]\ t \leq 500 \tag{10}$$

$$= s_3[t]\ t > 500$$

$$s_2[t] = \sin(2\pi t/N) + 0.1 * n[t]$$

$$s_3[t] = \sin(2\pi 3t/N) + 0.1 * n'[t]$$

where n[t]; n'[t] are white noise (i.e., Gaussian) with zero mean and unit standard deviation. Thus, $s_1$ switches at t=500, and tracks $s_3$, as opposed to $s_2$. This switch could happen, for example, in currency exchange rates, due to the signing of an international treaty between the involved nations.

The experiments were designed to address the following questions:

1) Prediction accuracy: How well can the present invention fill in the missing values compared with straightforward heuristics. Following the tradition in forecasting, the RMS (root mean square) error is used.

2) Speed: How much faster is the present invention using preprocessing versus the present invention without preprocessing, and at what cost in accuracy.

3) Correlations: Can the present invention detect interesting correlation patterns among sequences.

4) Adaptation: Does the forgetting factor allow the present invention to adapt to sudden changes.

For the experiments, a window of width w=5 was used unless specified otherwise. The results of the present invention was compared to two popular and successful prediction methods:

1) "Yesterday" analysis: $\hat{s}_t = s_{t-1}$, that is, choose the latest value as the estimate for the missing value. This heuristic is the typical straw-man for financial time sequences, like stock prices and currency exchange rates, and actually matches or outperforms much more complicated heuristics in such settings.

2) "Single-sequence AR (auto-regressive)" analysis. This is the traditional, very successful Box-Jenkins AR methodology, which tries to express the $s_1[t]$ value as a linear combination of its past w values. It includes "Yesterday" as a special case (w=1).

A. The Present Invention without Preprocessing

Figure 4A:
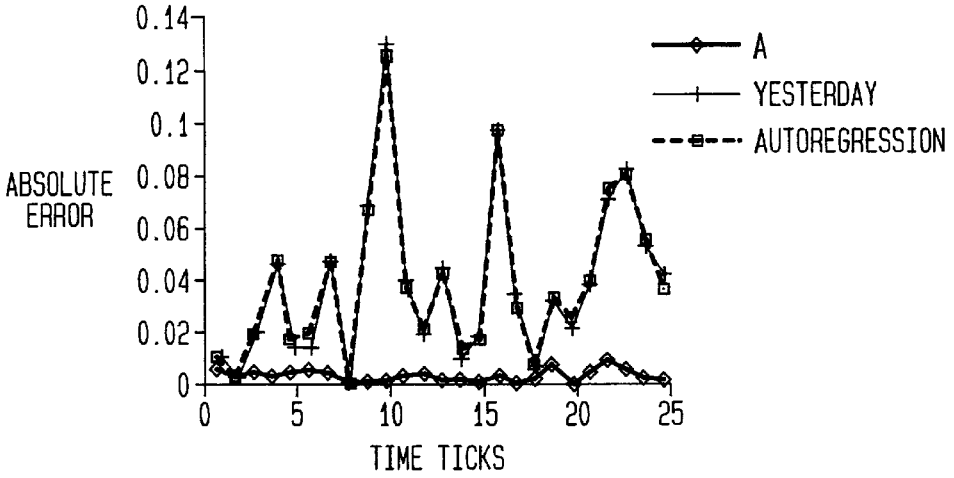
FIGS. 4*a,* 4*b* and 4*c* graphically illustrate the absolute value of the prediction error of the present invention and its competitors.
Figure 4B:
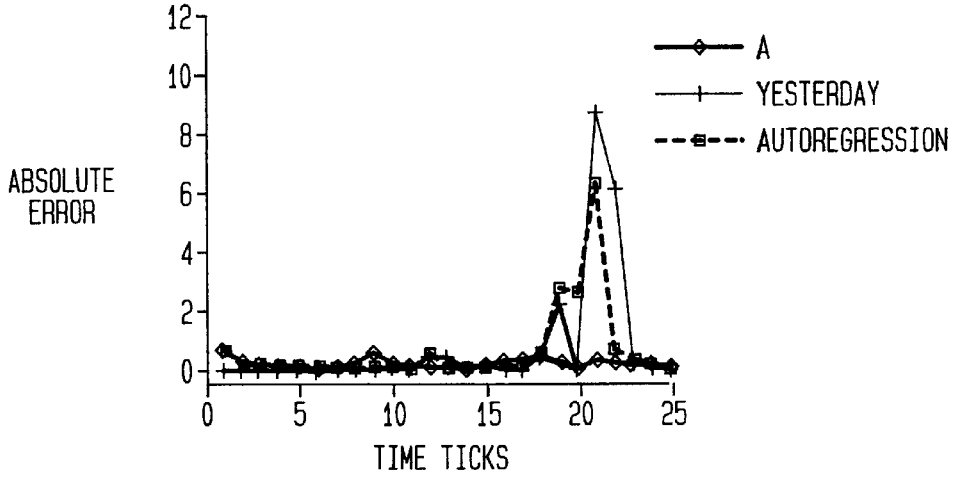
Figure 4C:
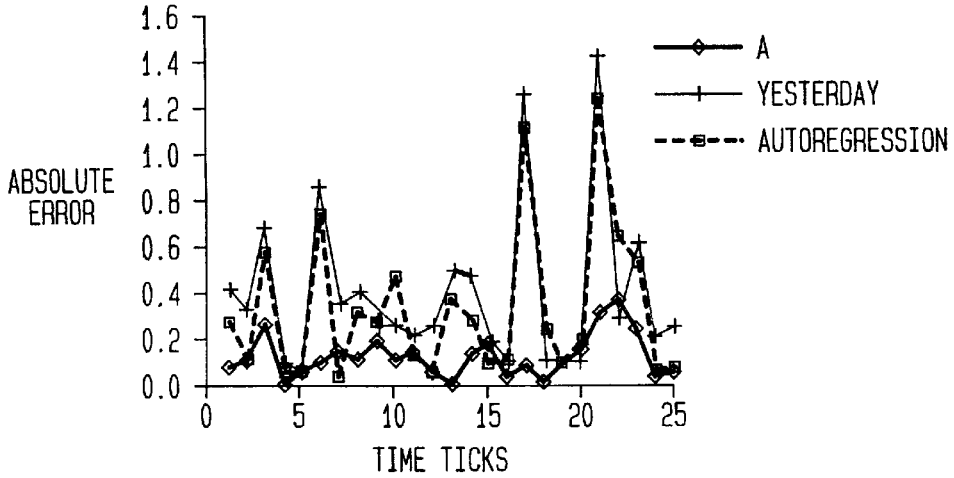

FIGS. 4*a,* 4*b* and 4*c* graphically illustrate the absolute value of the prediction error of the present invention (curve "A") and its competitors for three sequences, one from each dataset, for the last 25 time-ticks. In all cases, the present invention outperformed the competitors. It should be noted that, for the US Dollar (FIG. 4*a*), the "Yesterday" heuristic and the "AR" methodology gave very similar results. This is understandable, because the "Yesterday" heuristic is a special case of the "AR" method, and, for currency exchange rates, "Yesterday" is extremely good. However, the present invention does even better, because it exploits information not only from the past of the US Dollar, but also from the past and present of other currencies.

Figure 5A:
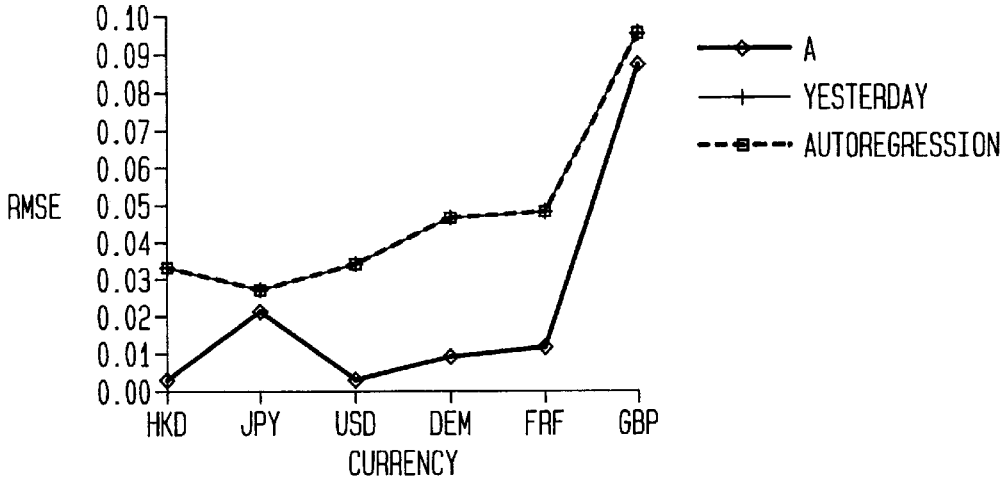
FIGS. 5*a,* 5*b* and 5*c* graphically illustrate the RMS error for some sequences of three real datasets.
Figure 5B:
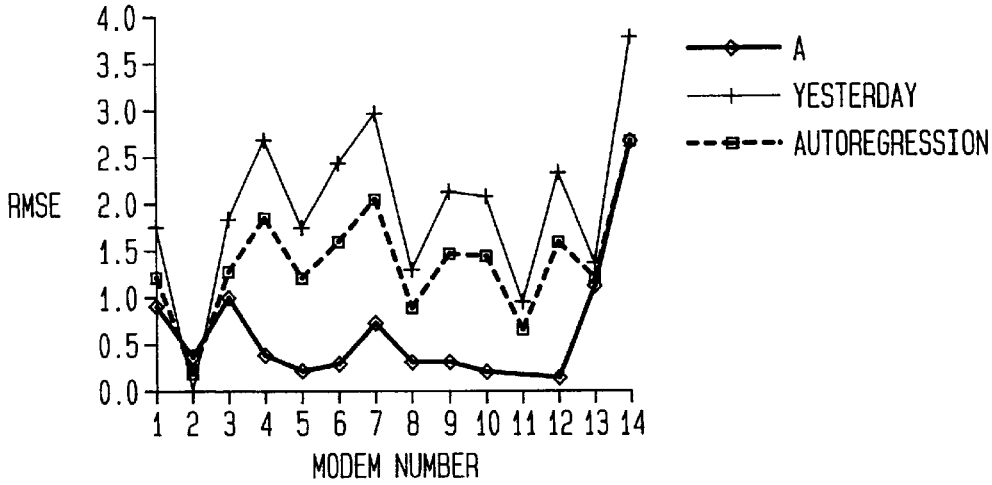
Figure 5C:
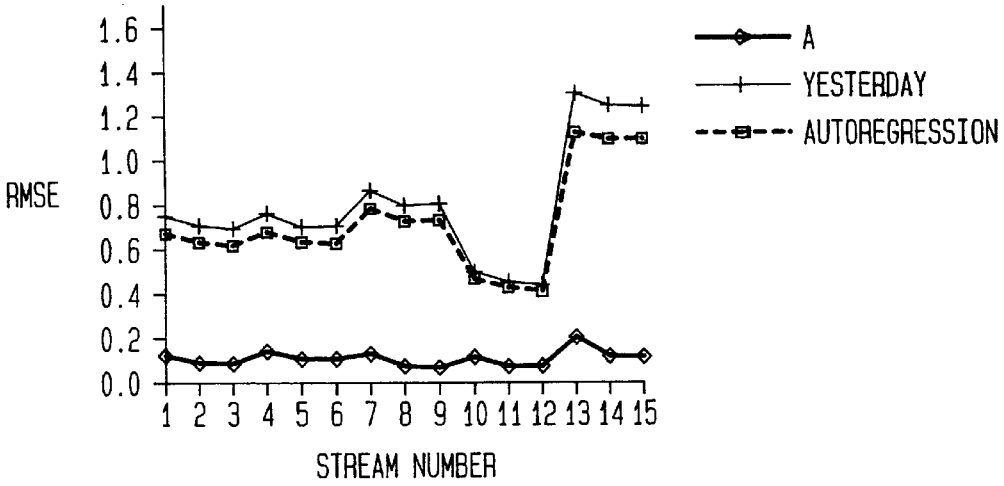

FIGS. 5*a,* 5*b* and 5*c* graphically illustrate the RMS error for some sequences of the three real datasets, CURRENCY (FIG. 5*a*), MODEM (FIG. 5*b*) and INTERNET (FIG. 5*c*). In the graphs, curve "A" are the results of the present invention. For each of the datasets, the horizontal axis lists the source, i.e., the "delayed" sequence $s_1$. For a given dataset, each of a few selected data sequences was designated as the "delayed" one, in turn. The observations are as follows:

1) Again, the present invention (curve "A") outperformed all alternatives, in all cases, except for just one case, the 2nd modem. The explanation is that in the 2nd modem, the traffic for the last 100 time-ticks was almost zero; and in that extreme case, the "Yesterday" heuristic is the best method.

2) For CURRENCY (FIG. 5*a*), the "Yesterday" and the AR methods gave practically identical errors, confirming the strength of the "Yesterday" heuristic for financial time sequences.

3) The present invention improved the prediction error by about 10 times, for USD and HKD, and by about 4.5 times for DEM and FRF.

4) For MODEM (FIG. 5*b*), the present invention reached up to 10 times savings over its competitors, and up to 9 times for INTERNET (FIG. 5*c*).

5) In general, if the present invention shows large savings for a time sequence, the implication is that this time sequence is strongly correlated with some other of the given sequences. The "Yesterday" and AR methods are oblivious to the existence of other sequences, and thus fail to exploit correlations across sequences. The other side of the argument is that, if the present invention shows little or no savings for a given sequence, then this sequence is fairly independent from the other ones. For example, the JPY (in the 'CURRENCY' dataset) apparently is not related to the other currencies.

B. The Present Invention with Preprocessing

Figure 6A:
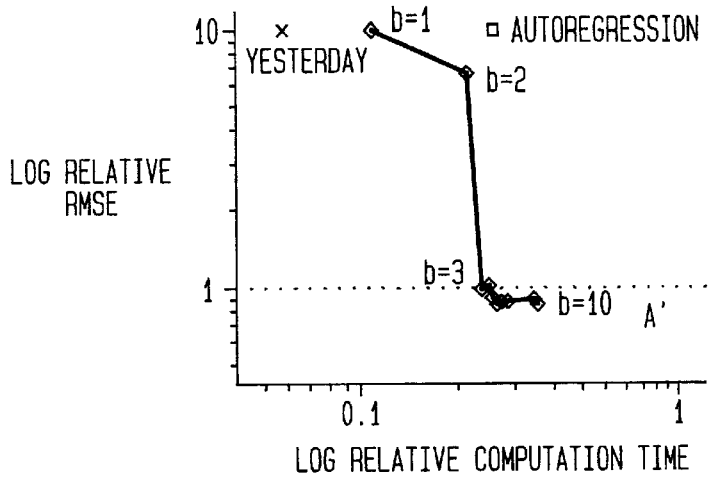
FIGS. 6*a,* 6*b* and 6*c* graphically illustrate the RMS error versus the computation time at each time-tick.

As previously discussed, even with the most efficient implementation (i.e., RLS),the complexity to update the regression coefficients at each time tick is $O(v^2)$. The present invention with preprocessing tries to bypass the problem, by finding the best b (<<v) independent variables that can predict the designated sequence $s_1$. The question is how much accuracy is sacrificed, and what are the gains in speed. FIGS. 6*a,* 6*b* and 6*c* graphically illustrate the speed-accuracy trade-off of the present invention with preprocessing (designated as "A").

Figure 6B:
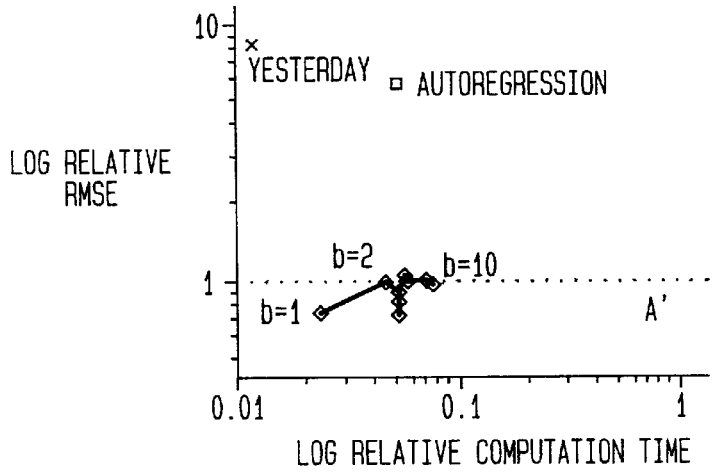
Figure 6C:
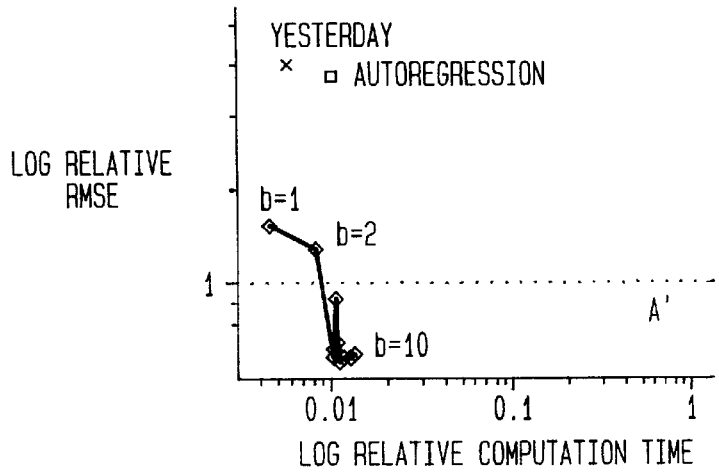

In FIGS. 6*a,* 6*b* and 6*c* the RMS error versus the computation time at each time-tick in a double logarithmic scale is plotted. The computation time per time-tick adds the time to forecast the delayed value, plus the time to update the regression coefficients. The reference point is the present invention with preprocessing on all v (referred to as "A" in FIG. 6). For ease of comparison across several datasets, both measures have been normalized (the RMS error as well as the computation time), by dividing by the respective measure for the present invention. For each set-up, the number b of independent variables picked is varied. FIG. 6 illustrates the error-time plot for the same three sequences: the US Dollar (CURRENCY, FIG. 6*a*), the 10-th modem (MODEM, FIG. 6*b*), and the 10-th stream (INTERNET, FIG. 6*c*).

The following observations can be made:

1) For every case, there is close to an order of magnitude (and usually much more) reduction in computation time, if there is a willingness to tolerate ≦15% increase in RMS error.

2) Specifically, for the USD, when choosing b=1 variable the error is identical to the "Yesterday" and to the AR model, with differing computation times. In this case, the regression equation was:

$$\widehat{USD}[t]=0.999*USD[t-1] \tag{11}$$

For b=2, the next best predictor for USD is HKD today, decreasing the relative error from 9.43 to 6.62. The third best predictor is "yesterday's value of the HKD", with 1.13 relative error and 0.22 relative computation time.

3) In most of the cases b=3–5 best-picked variables suffice for accurate prediction.

4) The graphs in FIG. 6 shows that the present invention with preprocessing is very effective, achieving up to two orders of magnitude speed-up (INTERNET, FIG. 6*a,* 10-th stream), with small deterioration in the error, and often with gains.

The most interesting and counter-intuitive observation is that using more information (independent variables) may often hurt the prediction accuracy. Specifically, the 10-th modem enjoyed 76% of the error of the present invention with preprocessing for 3% of the time. Similarly, the 10-th stream enjoyed 80% of the error for 1% of the time. The explanation is that, when there are several independent variables, the multi-variate regression tends to do an over-fitting. Carefully choosing a few good variables avoids this problem.

C. The Forgetting Factor

Figure 7A:
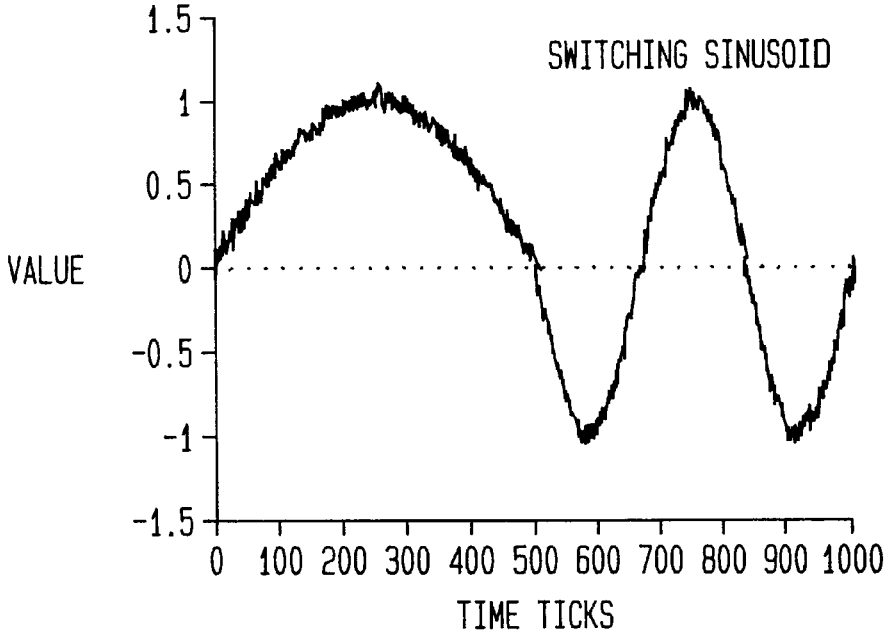
FIGS. 7*a* and 7*b* graphically illustrate the absolute error versus time-ticks with and without "forgetting".
Figure 7B:
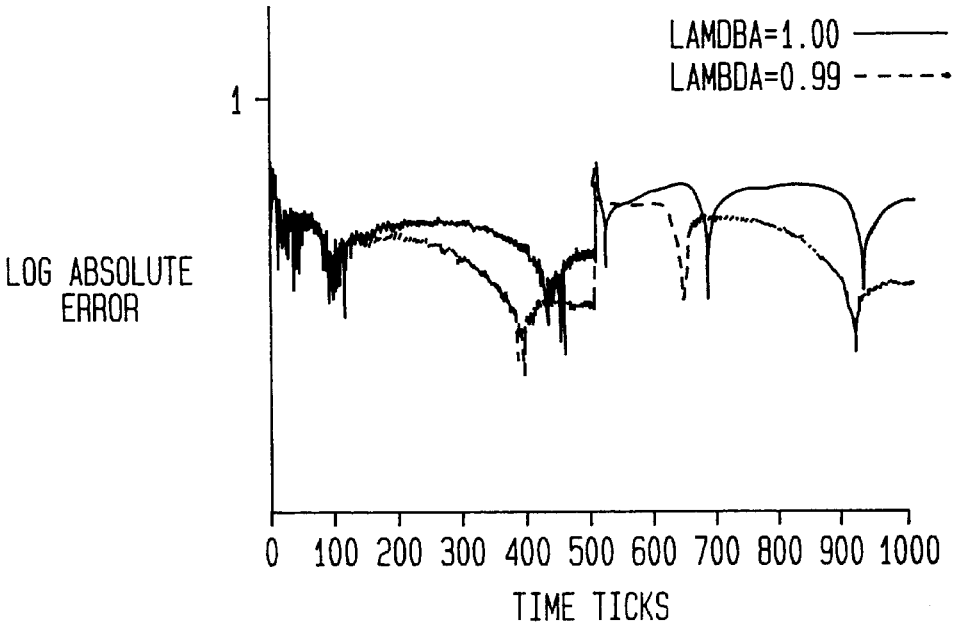

The effect of the forgetting factor (λ) was tested on the synthetic "SWITCH" dataset. Recall that $s_1$ tracks $s_2$ for the first half of the time, and then suddenly switches and tracks $s_3$. FIGS. 7*a* and 7*b* graphically illustrate the absolute error versus time-ticks with and without "forgetting", with λ=1 (i.e., no "forgetting") and λ=0.99.

The present invention without "forgetting" does not adapt so quickly to the change: there is a big surge at t =500, as expected, but the present invention with λ=0.99 recovers faster from the shock. The regression equations after t=1000 when w=0 are:

$$\hat{s}_1[t]=0.499*s_2[t]+0.499*s_3[t]\ (\lambda=1) \tag{12}$$

for the "non-forgetting" version and $$\hat{s}_1[t]=0.0065*s_2[t]+0.993*s_3[t]\ (\lambda=0.99) \tag{13}$$

for the "forgetting" one. Therefore, the "forgetting" version of the present invention has effectively ignored the first 500 time ticks, and has identified the fact that s, has been tracking $s_3$ closely. In contrast, the non-forgetting version gives equal weight (–0.5) to $s_2$ and $s_3$ alike, as expected.

D. Correlations

Figure 8A:
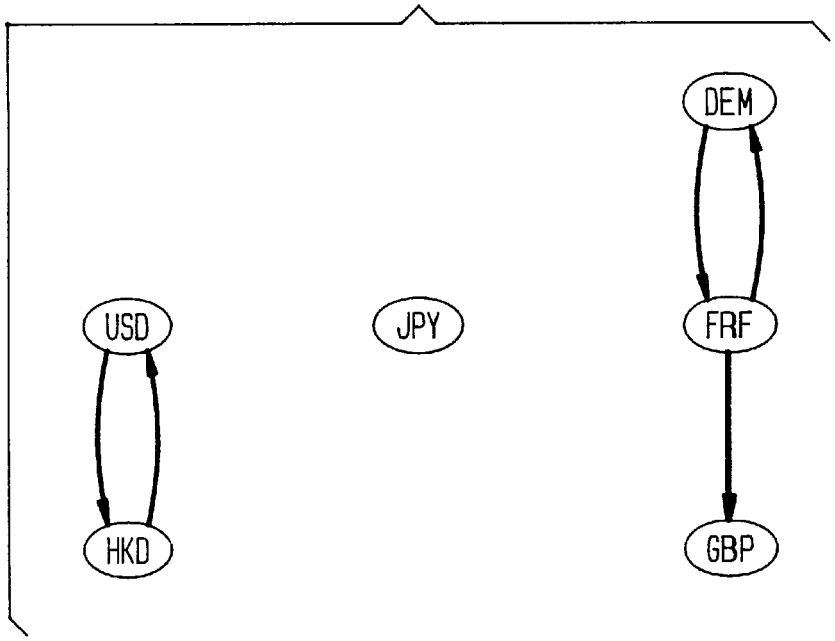
FIGS. 8*a* and 8*b* graphically illustrate how the present invention can help in detecting correlations.
Figure 8B:
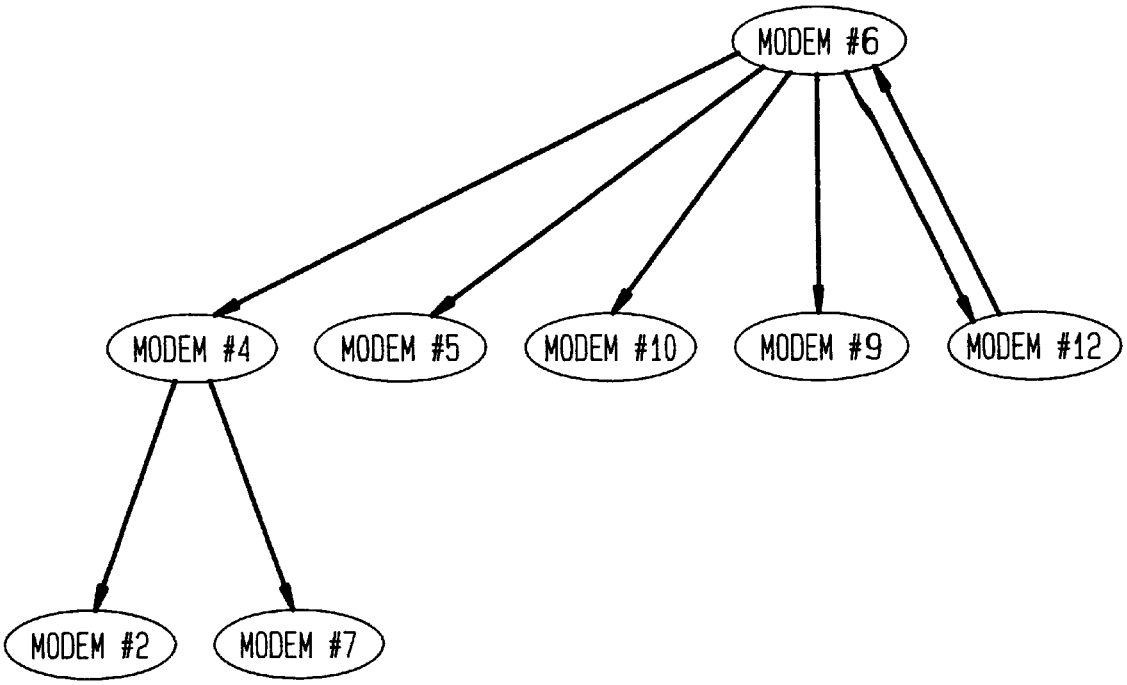

FIGS. 8*a* and 8*b* graphically illustrate how the present invention can help in detecting correlations. The most striking example is the correlation between USD and HKD from the CURRENCY dataset (FIG. 8*a*). There, treating the USD as the delayed sequences $s_1$, it was found that:

$$\widehat{USD}[t]=0.6085*USD[t-1]+0.9837*HKD[t]-0.5664*HKD[t-1] \tag{14}$$

after ignoring regression coefficients less than 0.3. This implies that the USD and the HKD are closely correlated. This is due to a Hong-Kong government policy which pegs the HKD to the USD, starting Oct. 17th, 1983, and thus it was in effect in the CURRENCY dataset (which started on Jan. 2nd, 1987). The correlation is not perfect: as was seen in FIG. 6*a,* the best predictor for today's USD value is "Yesterday's" USD value, and not the HKD value of today.

The "correlation graphs" illustrated in FIGS. 8*a* and 8*b* are used as a graphical tool to illustrate significant correlations among the time sequences. In the graphs, a node corresponds to a sequence, and a directed edge from node A to node B means A is a significant indicator of B. A thick arrow indicates a regression coefficient with a high absolute value (0.65 for CURRENCY and 0.5 for MODEM). The threshold for a thin arrow is 0.3 for both; smaller regression coefficients are not shown in the graph. From these correlation graphs, the following observations can be made:

1) CURRENCY: The HKD and the USD are strongly correlated, as previously discussed.

2) Moreover, the DEM and the FRF are also correlated, apparently because they are both the driving forces behind the unification of the European Community. This strong mutual correlation explains why both of them enjoy large improvements in accuracy when the present invention is used, as shown in FIG. 5*a*.

3) The converse is true for the Japanese Yen (JPY); this is the reason that the present invention only barely outperforms AR and "Yesterday" in FIG. 5(*a*).

4) MODEM: The 6-th modem strongly affects other modems. For example, looking at the 12-th modem, $$\widehat{USD}[t]=0.8685*M_6[t]+0.1217*M_{12}[t-1].$$

As described the present invention provides a method and apparatus for analyzing co-evolving time sequences such as currency exchange rates, network traffic data, and demographic data over time. The present invention has the following advantages over the prior art:

1) it allows for data mining and discovering correlations (with or without lag) among the given sequences;

2) it allows for forecasting of missing/delayed values;

3) it can be made to adapt to changing correlations among time sequences, using known techniques from adaptive filtering (namely, "Exponentially Forgetting Recursive Least Squares");

4) it can scale up for huge datasets: being on-line, it can handle sequences of practically infinite duration; the present invention with preprocessing can handle a large number of sequences, choosing the few ones that matter most, and improving the computation time quadratically, with little penalty in accuracy (and often with an improvement in accuracy).

Several embodiments of the present invention are specifically illustrated and/or described herein. However, it will be appreciated that modifications and variations of the present invention are covered by the above teachings and purview of the appended claims without departing from the spirit and intended scope of the invention.

What is claimed is:

1. A method of reconstructing missing data of a time sequence, comprising at a data receiver:

(a) receiving a plurality of co-evolving time sequences of data including at lest one time sequence of data having a portion of missing data wherein the plurality of time sequences comprise one or more known time sequences, and wherein the plurality of time sequences have a present value and (N−1) past values, wherein N is the number of samples of each time sequence, (b) determining a window size (w);

(c) assigning the missing data of the time sequence as a dependent variable;

(d) assigning the present value of a subset of the known time sequences, and any known past values of the plurality of time sequences as a plurality of independent variables, wherein the past values are delayed by up to w steps;

(e) forming an equation comprising the dependent variable and the independent variables;

(f) solving the equation using a least squares method;

(g) reconstructing the missing data using the solved equation.

2. The method of claim 1, wherein the subset of known time sequences is all of the one or more known time sequences.

3. The method of claim 1, further comprising the step of:

preprocessing the one or more known time sequences;

wherein the subset of known time sequences is less than all of the one or more known time sequences.

4. The method of claim 3, wherein the step of preprocessing minimizes an expected prediction error (EPE) for the dependent variable.

5. The method of claim 4, wherein the step of preprocessing comprises the steps of:

selecting a first time sequence with the minimum EPE from a first set that comprises the one or more known time sequences;

adding the first time sequence to a second set that comprises the subset of known time sequences;

removing the first time sequence from the first set;

determining whether the second set includes a predetermined number of known time sequences; and if it is determined that the second set does not include the predetermined number of known time sequences, repeating the selecting step.

6. The method of claim 1, wherein the least squares method is Recursive Least Squares.

7. The method of claim 1, wherein the least squares method is Exponentially Forgetting Recursive Least Squares.

8. The method of claim 1, wherein the equation substantially comprises the following: $D^1(s_1), \ldots, D^w(s_1), s_2, D^1(s_2), \ldots, D^w(s_2), \ldots, s_k, D^1(s_k), \ldots, D^w(s^k)$;

wherein $s_1$ is the delayed time sequence, $s_2 \ldots s_k$ are the one or more known time sequences, and $D^1(s)$ and $D^w(s)$ are delay operators.

9. The method of claim 1, wherein the step (g) provides correlation detection for the plurality of co-evolving time sequences.

10. The method of claim 1, wherein the step (g) provides outlier detection for the plurality of co-evolving time sequences.

11. The method of claim 1, wherein the samples comprise time-ticks.

12. An analyzer system that analyzes a plurality of co-evolving time sequences, wherein the plurality of time sequences comprise a delayed time sequence and one or more known time sequences, and wherein the plurality of time sequences have a present value and (N−1) past values, wherein N is the number of samples of each time sequence, said system comprising a processor that:

receives the plurality of co-evolving time sequences;

determines a window size (w);

assigns the delayed time sequence as a dependent variable;

assigns the present value of a subset of the known time sequences, and the past values of the subset of known time sequences and the delayed time sequence, as a plurality of independent variables, wherein the past values are delayed by up to w steps;

forms an equation comprising said dependent variable and said independent variables;

solves said equation using a least squares method; and determines the delayed time sequence using said solved equation.

13. The system of claim 12, wherein said subset of known time sequences is all of the one or more known time sequences.

14. The system of claim 12, wherein the processor further:

preprocesses said one or more known time sequences; wherein said subset of known time sequences is less than all of the one or more known time sequences.

15. The system of claim 14, wherein the processor minimizes an expected prediction error (EPE) for said dependent variable.

16. The system of claim 15, wherein the processor selects a first time sequence with the minimum EPE from a first set that comprises the one or more known time sequences;

adds the first time sequence to a second set that comprises the subset of known time sequences;

removes the first time sequence from the first set; and determines whether the second set includes a predetermined number of known time sequences.

17. The system of claim 12, wherein said least squares method is Recursive Least Squares.

18. The system of claim 12, wherein said least squares method is Exponentially Forgetting Recursive Least Squares.

19. The system of claim 12, wherein said equation substantially comprises the following: $D^1(s_1), \ldots, D^w(s_1), s_2, D^1(s_2), \ldots, D^w(s_2) \ldots, s_k, D^1(s_k), \ldots, D^w(s_k)$;

wherein $s_1$ is the delayed time sequence, $s_2 \ldots s_k$ are the one or more known time sequences, and $D^1(s)$ and $D^w(s)$ are delay operators.

20. The system of claim 12, wherein the processor provides correlation detection for said plurality of co-evolving time sequences.

21. The system of claim 12, wherein the processor provides outlier detection for said plurality of co-evolving time sequences.

22. The system of claim 12, wherein the samples comprise time-ticks.

23. A computer readable medium storing thereon program instructions that, when executed by a processor, cause the processor to:

(a) receive a plurality of co-evolving time sequences of data, wherein the plurality of time sequences comprise one or more known time sequences and a time sequence having a portion characterized by missing data, and wherein the plurality of time sequences have a present value and (N−1) past values, wherein N is the number of samples of each time sequence, (b) determining a window size (w);

(c) assigning the missing data of the time sequence as a dependent variable;

(d) assigning the present value of a subset of the known time sequences, and any known past values of the plurality of time sequences as a plurality of independent variables, wherein the past values are delayed by up to w steps;

(e) forming an equation comprising the dependent variable and the independent variables;

(f) solving the equation using a least squares method;

(g) reconstructing the missing data using the solved equation.

* * * * *